US009435172B2

(12) United States Patent
Oettli et al.

(10) Patent No.: US 9,435,172 B2
(45) Date of Patent: Sep. 6, 2016

(54) COMPRESSION-ACTUATED MULTI-CYCLE CIRCULATION VALVE

(71) Applicant: Schlumberger Technology Corporation, Sugar Land, TX (US)

(72) Inventors: Mark C. Oettli, Richmond, TX (US); L. Michael McKee, Livingston, TX (US); Robert L. Bucher, III, Houston, TX (US); Mohammad Hajjari, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 294 days.

(21) Appl. No.: 14/065,093

(22) Filed: Oct. 28, 2013

(65) Prior Publication Data

US 2015/0114644 A1 Apr. 30, 2015

(51) Int. Cl.

| | |
|---|---|
| ***E21B 34/08*** | (2006.01) |
| ***E21B 12/06*** | (2006.01) |
| ***E21B 37/02*** | (2006.01) |
| ***E21B 21/10*** | (2006.01) |
| *E21B 34/00* | (2006.01) |

(52) U.S. Cl.

CPC ..... *E21B 34/08* (2013.01); *E21B 12/06* (2013.01); *E21B 21/103* (2013.01); *E21B 37/02* (2013.01); *E21B 2034/007* (2013.01)

(58) Field of Classification Search

CPC ..... E21B 10/32; E21B 10/322; E21B 12/06; E21B 34/14; E21B 37/02; E21B 37/045

See application file for complete search history.

(56) References Cited

U.S. PATENT DOCUMENTS

| | | | | |
|---|---|---|---|---|
| 1,375,093 | A * | 4/1921 | Hanson | E21B 10/32 175/287 |
| 4,161,216 | A * | 7/1979 | Amancharla | E21B 23/02 166/125 |
| 4,889,199 | A | 12/1989 | Lee | |
| 5,560,440 | A * | 10/1996 | Tibbitts | E21B 10/20 175/286 |
| 5,743,331 | A | 4/1998 | Adkins et al. | |
| 7,007,865 | B2 | 3/2006 | Dodd | |
| 7,377,283 | B2 | 5/2008 | Walker et al. | |
| 2004/0124011 | A1 * | 7/2004 | Gledhill | E21B 10/62 175/57 |
| 2006/0243493 | A1 | 11/2006 | El-Rayes et al. | |
| 2010/0270034 | A1 | 10/2010 | Clausen | |
| 2011/0056703 | A1 | 3/2011 | Eriksen et al. | |
| 2011/0315389 | A1 | 12/2011 | Crider et al. | |

OTHER PUBLICATIONS

International Search Report and Written Opinion issued in PCT/US2014/062044 on Feb. 6, 2015, 12 pages.

* cited by examiner

*Primary Examiner* — Cathleen Hutchins

(74) *Attorney, Agent, or Firm* — Michael L. Flynn; Tim Curington

(57) ABSTRACT

A downhole tool conveyed via tubing within a wellbore at a wellsite comprises a hydraulic tool driven by fluid pumped to the hydraulic tool via the tubing. The downhole tool further comprises a valve in fluid communication between the tubing and the hydraulic tool. The valve is configurable in the wellbore between an expanded position, establishing a bypass diverting at least a portion of the pumped fluid away from the hydraulic tool, and a compressed position, closing the bypass.

16 Claims, 3 Drawing Sheets

COMPRESSION-ACTUATED MULTI-CYCLE CIRCULATION VALVE

BACKGROUND OF THE DISCLOSURE

Coiled tubing may be utilized with a milling tool and/or other cleaning apparatus to, for example, remove downhole debris such as sand, proppant, scale, etc., which may also be referred to as "fill." Such cleanout operations can be challenging in lengthy and/or horizontal wells. In such scenarios, a milling motor may be utilized at the end of a bottom-hole-assembly (BHA) to, for example, reduce debris, obstructions, and other obstacles to a particle size sufficient to ensure they become entrained in drilling fluid to be brought to the surface. However, with horizontal or offset wellbores, the fill may settle behind the BHA, thereby re-creating a partial blockage.

SUMMARY OF THE DISCLOSURE

The present disclosure introduces an apparatus comprising a downhole tool operable for conveyance via tubing within a wellbore extending from a wellsite. The downhole tool may include a hydraulic tool driven by fluid pumped to the hydraulic tool via the tubing. The downhole tool may also include a valve in fluid communication between the tubing and the hydraulic tool. The valve may be configurable in the wellbore between an expanded position, establishing a hydraulic tool bypass diverting at least a portion of the pumped fluid away from the hydraulic tool, and a compressed position, closing the hydraulic tool bypass.

The present disclosure also introduces an apparatus comprising a mandrel having an axial aperture therethrough and a first radial aperture in fluid communication with the axial aperture. A body surrounding the mandrel has a second radial aperture. The mandrel is urged by hydraulic pressure towards a first position in which the first and second radial apertures are substantially aligned. The mandrel is urged by mechanical force towards a second position in which the first and second radial apertures are substantially not aligned.

The present disclosure also introduces a method comprising conveying a downhole tool within a wellbore extending from a wellsite surface, via tubing, until an obstruction in the wellbore compresses a valve of the downhole tool. Operation of the downhole tool is then adjusted by adjusting a pumping pressure or flow rate at which fluid is pumped to the downhole tool from the wellsite surface. Operation of the downhole tool is continued until the valve expands and establishes a flowpath from the valve to the wellbore bypassing the downhole tool.

Additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
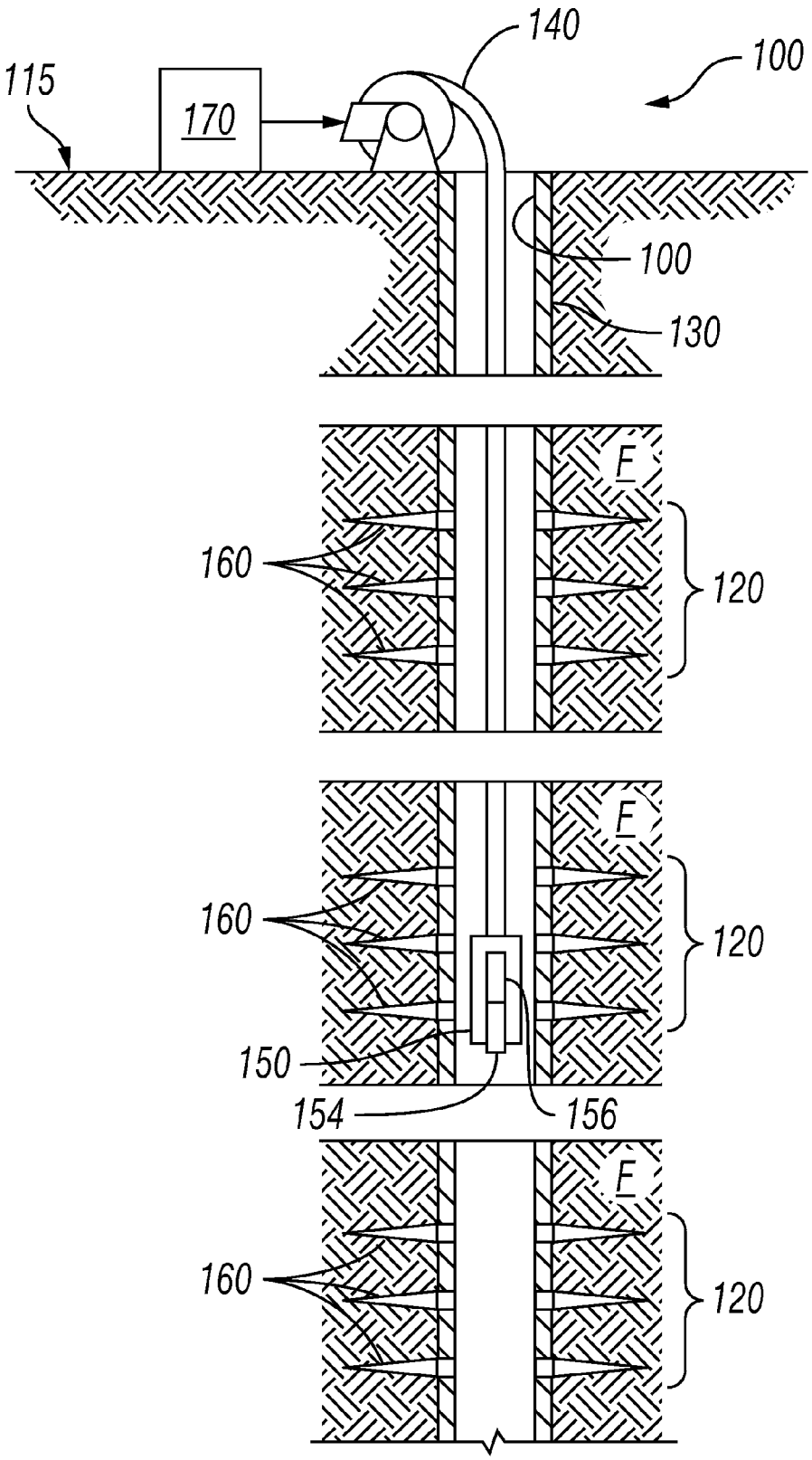
FIG. 1 is a schematic view of at least a portion of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a schematic view of at least a portion of a wellsite 100 according to one or more aspects of the present disclosure. The wellsite 100 comprises a wellbore 110 that intersects one or more subterranean formations F, perhaps through multiple zones of interest 120. At least a portion of the wellbore 110 may be cased and thus comprise a casing string 130, although one or more aspects of the present disclosure may be similarly applicable and/or readily adaptable for use with uncased or "open" wellbores. The casing string 130 may be cemented in the wellbore 110, such as by pumping cement into the annulus between the casing string 130 and the sidewalls of the wellbore 110. However, the casing string 130 may not be cemented, such as where the casing string 130 lines a lateral or other section of the wellbore 110. Thus, it is appreciated that the casing string 130 may be a liner, broadly considered herein as any form of casing, including that which may not extend to the surface 115, such as a specific interval length along a vertical, horizontal, and/or deviated wellbore.

A conveyance string 140 comprising and/or otherwise coupled to a bottom-hole assembly (BHA) 150 may extend downhole from the surface 115 of the wellsite 100 into the wellbore 110. The conveyance string 140 may be or comprise coiled tubing with suitable surface equipment such as a coiled tubing injector and the like, as will be appreciated by those skilled in the art. However, one or more aspects of the present disclosure may be similarly applicable and/or readily adaptable for use with another type of string, such as a drillstring and/or other jointed tubing string, wired drill pipe, wireline, slickline, and/or others.

The wellsite 100 is depicted in FIG. 1 as being in a state in which fluid connectivity between the wellbore 110 and the zones 120 has been established, as depicted by perforations 160 that penetrate the casing string 130 and extend into the surrounding formation(s) F. Jetting subs and/or shaped-charge perforating guns, among other possible examples, may be utilized to perform perforation of the zones 120.

The wellsite 100 may comprise a working fluid source 170 at the surface 115, such as may be utilized to hydraulically power a hydraulic tool 154 carried by and/or forming part of the BHA 150. The working fluid source 170 may supply, for example, hydraulic oil, slurry, and/or other fluids through a passageway of the conveyance string 140, such that the fluid may drive a rotational and/or other motive element of the hydraulic tool 154. The BHA 150 also comprises a compression-actuated, multi-cycle valve 156, which is operable to divert at least a portion of the working fluid received from the working fluid source 170 into the wellbore 110 while bypassing the hydraulic tool 154, such as to clean fill out of the wellbore 110.

Figure 2:
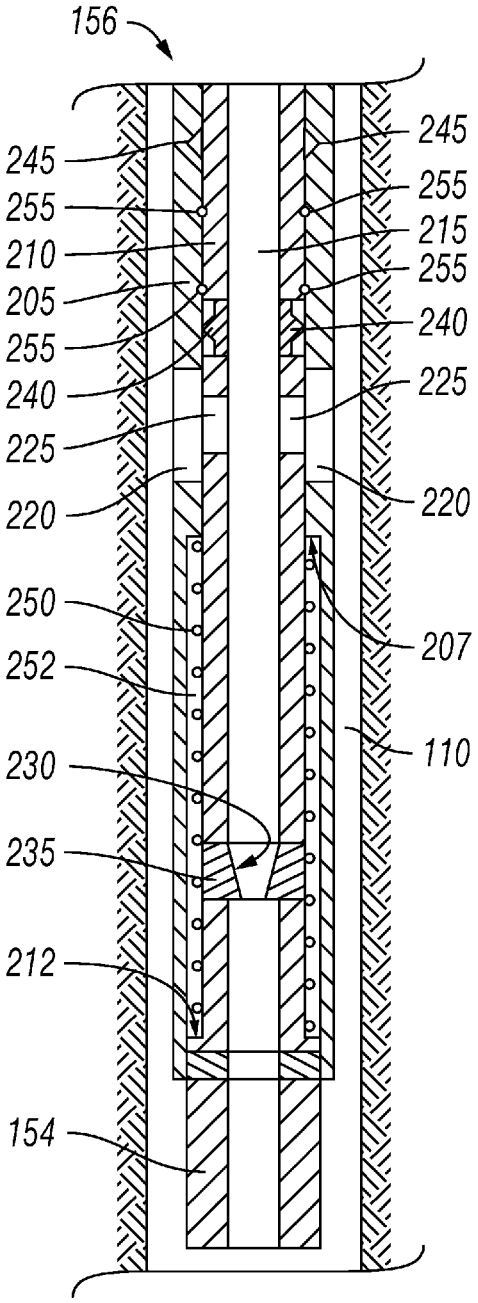
FIG. 2 is a schematic view of at least a portion of apparatus according to one or more aspects of the present disclosure.
Figure 3:
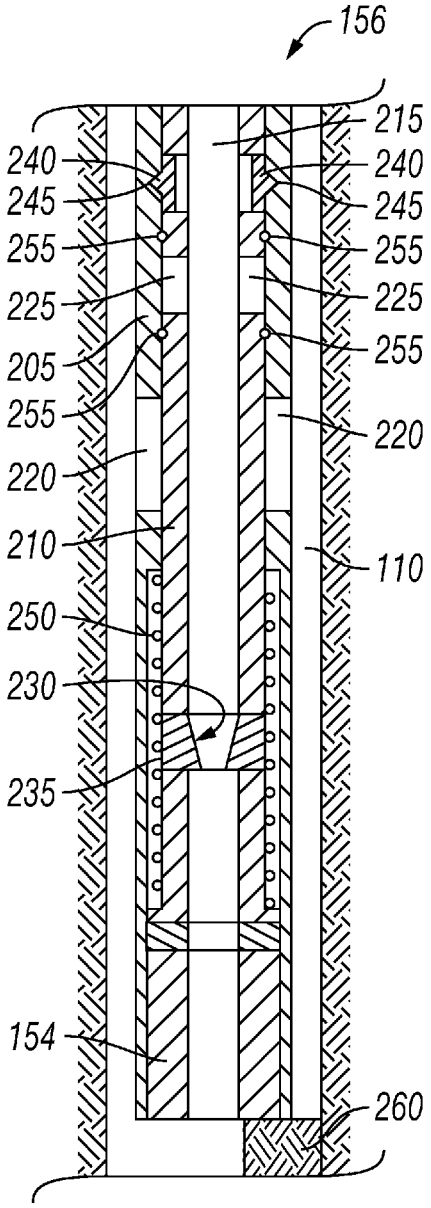
FIG. 3 is a schematic view of at least a portion of apparatus according to one or more aspects of the present disclosure.

FIGS. 2 and 3 depict at least a portion of the valve 156, among other components of the BHA 150 that may also be depicted in FIGS. 2 and 3. The valve 156 comprises a body 205 and a mandrel 210 slidably disposed within the body 205. The body 205 includes one or more radial apertures 220, and the mandrel 210 includes an axial aperture 215 and one or more radial apertures 225. The valve 156 further comprises an orifice 230, which may be carried by a piston 235 that slides with the mandrel 210 within the body 205. However, in other implementations within the scope of the present disclosure, the orifice 230 may impart motion and/or be carried with the mandrel 210 by means other than the piston 235.

The mandrel 210 slidably rides within the body 205 between an expanded first position (FIG. 2) and a compressed second position (FIG. 3). The first position may be utilized during a circulation mode, such as for cleaning fill out of the wellbore 110, and the second position may be utilized during other modes, such as for milling through an obstacle 260 in the wellbore 110. The lower end of the mandrel 210 (relative to the orientation shown in FIGS. 2 and 3) and/or a device coupled thereto may be or comprise the milling or other hydraulic tool 154 operably driven by the working fluid and/or otherwise operable to perform one or more downhole tasks. For example, the hydraulic tool 154 may comprise a milling bit and/or other feature operable to remove and/or reduce fill in the wellbore 110, such as to remove obstructions and/or reduce the particle size of fill so that the working fluid can convey it to surface.

The radial apertures 220 of the body 205 are substantially aligned with the radial apertures 225 of the mandrel when the valve 156 is in the first position, as shown in FIG. 2, thus establishing fluid communication between the axial aperture 215 and the wellbore 110. As such, at least a portion of the working fluid received in the axial aperture 215 from surface may bypass the hydraulic tool 154. For example, if the working fluid composition would be corrosive or otherwise damaging to the hydraulic tool 154, some or all of the working fluid may bypass the hydraulic tool 154 via the flowpath created between the axial aperture 225 and the wellbore 110 via substantial alignment of the radial apertures 220 and 225. Some or all of the working fluid may similarly bypass the hydraulic tool 154 in implementations in which the hydraulic tool 154 has a maximum operating hydraulic pressure rating that is less than the hydraulic pressure utilized during circulation and/or other downhole operations. Relative translation of the mandrel 210 and the body 205 moves the radial apertures 220 and 225 out of alignment, such as in the second position shown in FIG. 3, thus interrupting fluid communication between the axial aperture 215 and the wellbore 110 via the bypass. Thus, when in the compressed configuration shown in FIG. 3, the valve 156 may direct the working fluid to the wellbore 110 via the hydraulic tool 154 instead of the bypass flowpath.

Hydraulic pressure created by the flow rate output of one or more pumps and/or other components of the working fluid source 170 shown in FIG. 1 acts on the orifice 230 to urge the mandrel 210 in a downhole direction relative to the body 205. That is, the shape and size of the orifice 230 creates a pressure differential, with the high pressure on the uphole side of the orifice 230 overcoming the lower pressure on the downhole side of the orifice 230, thus urging the mandrel 210 in a downhole direction. The extent to which cross-sectional flow area of the orifice 230 is smaller than that of the axial aperture 215 may vary within the scope of the present disclosure. For example, the cross-sectional flow area of the orifice 230 may range between about 5% and about 50% of the cross-sectional flow area of the aperture 215, although other values are also within the scope of the present disclosure.

Such axial relative translation of the body 205 and mandrel 210 may be restricted by a collet 240 carried with the mandrel 210. When the valve 156 is compressed (FIG. 3), the collet 240 and a corresponding recess and/or other feature 245 of the body 205 may be engaged. Engagement of the collet 240 and the feature 245 may impart an axial force on the mandrel 210 resisting the force imparted by the working fluid acting on the orifice 230, thus preventing further downhole movement of the mandrel 210 with respect to the body 205. Corresponding sloped surfaces of the collet 240 and the feature 245 may be configured to cooperatively impart the resistive axial force at a predetermined level dependent upon the size and shape of the orifice 230 and the planned hydraulic pressure and/or flow rate of the working fluid, among other factors.

An uphole mechanical force may be applied to the hydraulic tool 154 by advancing the BHA 150 (FIG. 1) against an obstruction 260 in the wellbore 110. When this uphole mechanical force exceeds the hydraulic pressure in the axial aperture 215 on the uphole side of the orifice 230, the mandrel 210 may slide towards the compressed or operating position (FIG. 3). However, the hydraulic tool 154 may comprise a stator-rotor arrangement, and rotation of the rotor may not be able to commence while the hydraulic tool 154 continues to be in contact with the obstruction 260 exerting the uphole mechanical force. Accordingly, after the valve 156 is compressed sufficiently to reengage the collet 240 and the feature 245, the BHA 150 may be temporarily moved uphole (e.g., "off-bottom") a short distance, such that the working fluid flowing through the axial aperture 215 may initiate rotation of the rotor. For example, this distance may be about two inches (or about five cm), or perhaps several feet (or about one meter), although other distances are also within the scope of the present disclosure. The engagement between the collet 240 and the feature 245 may resist the pressure of the working fluid acting on the orifice 230, such that the valve 156 may remain in the compressed position long enough to start rotation of the rotor.

The BHA 150 may then be advanced against the obstruction 260, and milling and/or other operation of the hydraulic tool 154 may proceed while the tool 154 is in the compressed position. The tool 154 is maintained in the compressed position by the interaction of the collet 240 and the feature 245, as discussed hereinabove as well as the uphole mechanical force applied to the tool by the obstruction 260. Upon breakthrough, the working fluid pressure and/or flow rate may be increased to a predetermined circulation pressure and/or flow rate, perhaps corresponding to a flow rate of about 3 bbls/min, although other pressures and rates are also within the scope of the present disclosure, which allows the valve 156 to move from the compressed position (FIG. 3) to the expanded position (FIG. 2), thus reestablishing the bypass flowpath through the radial apertures 220 and 225. The working fluid diverted by the bypass flowpath may disturb the milling debris just created and subsequently transport the debris to the surface. During circulation, a decreased amount of working fluid may be directed to the downhole tool 154. Such decrease may be predetermined by judicious choice of the relative sizes of the orifice 230, the axial aperture 215, and/or the radial apertures 220 and/or 225, among other factors.

The valve 156 may also comprise a biasing member 250 operable to assist the transition from the expanded position to the compressed position. For example, the biasing member 250 may comprise one or more compression springs, among other biasing devices, and may be contained with a sealed or unsealed chamber 252 between the mandrel 210 and the body 205, or otherwise establish a separation force on opposing shoulders 207 and 212 of the body 205 and the mandrel 210, respectively. In an embodiment, the body 205 may be movable relative to the mandrel 210, rather than the mandrel 210 movable relative to the body 205. In such an embodiment, the biasing member 250 may advantageously be enclosed and/or separated from the wellbore fluids including any debris generated by milling or the like.

The valve 156 may comprise one or more seals 255 further ensuring interruption of the bypass flowpath when the valve 156 is in the compressed position (FIG. 3). Such seals 255 may comprise one or more O-rings, wipers, and/or other sealing members.

Figure 4:
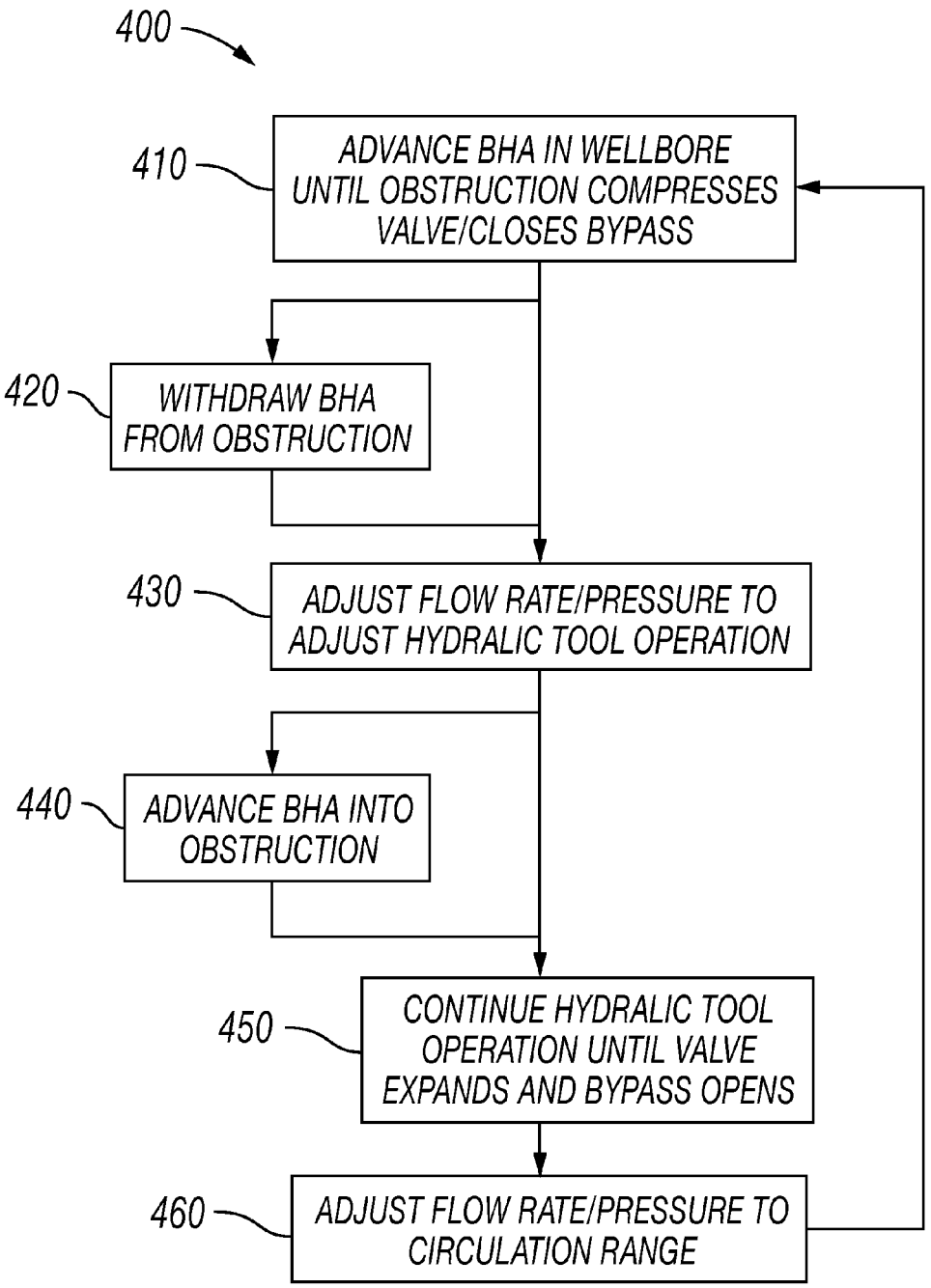
FIG. 4 is a flow-chart diagram of at least a portion of a method according to one or more aspects of the present disclosure.

FIG. 4 is a flow-chart diagram of at least a portion of a method (400) according to one or more aspects of the present disclosure. Referring to FIG. 4 with continuing reference to FIGS. 1-3, the BHA 150 may be advanced (410) in the wellbore 110 until an obstruction 260 compresses the valve 156, thus closing the bypass flowpath through the radial apertures 220 and 225. The BHA 150 may then be withdrawn (420) from the obstruction 260, and the working fluid pressure and/or flow rate may be adjusted (430) to adjust operation of the hydraulic tool 154, such as to start-up the hydraulic tool 154. As described above, some implementations within the scope of the present disclosure may utilize a hydraulic tool 154 that cannot be started while remaining in contact with the obstruction 260, so the hydraulic tool 154 may be brought off-bottom a short distance while rotation of the hydraulic tool 154 may commence, and the BHA 150 may then be advanced (440) back into the obstruction 260 and the hydraulic tool 154 may be engaged with the obstruction such as, but not limited to, milling the obstruction 260 or the like. In other implementations, however, the hydraulic tool 154 may be started while remaining in contact with the obstruction 260, or the hydraulic tool 154 may already be operating, such that the adjustment (430) to adjust operation of the hydraulic tool 154 may comprise adjusting a speed, torque, frequency, phase, and/or other operational parameter of the hydraulic tool 154. In such implementations, withdrawing (420) the BHA 150 from the obstruction 260 and advancing (440) the BHA 150 back into the obstruction 260 may be omitted.

Operation of the hydraulic tool 154 may then be continued (450) until the valve 156 expands and the bypass flowpath through the radial apertures 220 and 225 is again established. For example, in implementations in which the hydraulic tool 154 is or comprises a milling tool, milling through the obstruction 260 may be continued (450) until the hydraulic tool 154 breaks through the obstruction 260, such that the working fluid pressure and/or flow rate again expands the valve 156. This may include increasing the working fluid pressure and/or flow rate sufficient to overcome the resistive force imparted by the engagement between the collet 240 and the corresponding feature 245 of the body 205.

With the bypass flowpath now reestablished, the working fluid pressure and/or flow rate may be adjusted (460) or otherwise utilized to, for example, commence circulation to transport fill to the surface 115. One or more aspects of the method (400) shown in FIG. 4 may then be repeated any number of times, such that the mandrel 210 may be reciprocated between the expanded and compressed positions in response to an alternatingly greater one of (1) the mechanical force exerted by the obstruction 260 and (2) the working fluid hydraulic pressure acting on the orifice 230.

In view of the entirety of the present disclosure, including the figures, a person having ordinary skill in the art will readily recognize that the present disclosure introduces an apparatus comprising: a downhole tool operable for conveyance via tubing within a wellbore extending from a wellsite, wherein the downhole tool comprises: a hydraulic tool driven by fluid pumped to the hydraulic tool via the tubing; and a valve in fluid communication between the tubing and the hydraulic tool, wherein the valve is configurable in the wellbore between: an expanded position establishing a hydraulic tool bypass diverting at least a portion of the pumped fluid away from the hydraulic tool; and a compressed position closing the hydraulic tool bypass.

The tubing may comprise coiled tubing. The valve may comprise a body and a mandrel slidably disposed within at least a portion of the body. The hydraulic tool bypass may comprises: a first aperture extending radially from an interior passage of the mandrel to outside the mandrel; and a second aperture in the body establishing fluid communication between the first aperture and the wellbore in which the hydraulic tool. The first and second apertures may not be in fluid communication when the valve is in the compressed position. The downhole tool may further comprise a collet carried by the mandrel, and the collet and the body may be engaged when the valve is in the compressed position. The engagement between the collet and the body may resist transition of the valve from the compressed position to the expanded position.

The hydraulic tool bypass may divert the at least portion of the pumped fluid into the wellbore such that the at least portion of the pumped fluid diverted by the hydraulic tool bypass does not flow through the hydraulic tool.

Advancing the hydraulic tool into an obstruction in the wellbore may transition the valve away from the expanded position and towards the compressed position.

The downhole tool may further comprise an orifice operable to react against a pumping pressure of the pumped fluid and thereby urge the valve from the compressed position towards the expanded position.

The downhole tool may further comprise a biasing member urging the valve from the compressed position towards the expanded position.

The hydraulic tool may comprise a milling tool.

The present disclosure also introduces an apparatus comprising: a mandrel having an axial aperture therethrough and a first radial aperture in fluid communication with the axial aperture; and a body surrounding the mandrel and having a second radial aperture, wherein the mandrel is urged by hydraulic pressure towards a first position in which the first and second radial apertures are substantially aligned, and wherein the mandrel is urged by mechanical force towards a second position in which the first and second radial apertures are substantially not aligned. The mandrel may reciprocate between the first and second positions in response to an alternating one of the mechanical force and the hydraulic pressure being greater than the other. The mechanical force may be applied by advancing the apparatus against an obstruction in a wellbore.

The hydraulic pressure may be applied by a working fluid in the axial aperture. The apparatus may further comprise an orifice carried with the mandrel and operable to convert the hydraulic pressure to a sliding force on the mandrel toward the first position. The orifice may have a cross-sectional flow area that is smaller than that of the axial aperture.

The apparatus may further comprise a collet operable to releasably hold the mandrel in the second position.

The apparatus may further comprise a biasing member urging the mandrel towards the first position. The biasing member may comprise a spring, such as a compression spring.

The apparatus may further comprise a seal between the mandrel and the body. The seal may comprise an O-ring seal.

The hydraulic pressure may be that of a working fluid pumped into the axial aperture from a wellsite surface. The working fluid may exit the apparatus via the first and second radial apertures when the mandrel is in the first position. The working fluid may further exit the apparatus via the axial aperture when the mandrel is in the first position. The working fluid may exit the apparatus via the axial aperture when the mandrel is in either of the first and second positions. The apparatus may further comprise a hydraulic tool driven by the working fluid. The hydraulic tool may be a milling tool.

The present disclosure also introduces a method comprising: conveying a downhole tool within a wellbore extending from a wellsite surface via tubing until an obstruction in the wellbore compresses a valve of the downhole tool; adjusting operation of the downhole tool by adjusting a pumping pressure or flow rate at which fluid is pumped to the downhole tool from the wellsite surface; and continuing operation of the downhole tool until the valve expands and establishes a flowpath from the valve to the wellbore bypassing the downhole tool.

Adjusting operation of the downhole tool by adjusting the pumping pressure or flow rate may comprise adjusting rotation of a milling portion of the downhole tool. Adjusting rotation of the milling portion of the downhole tool may comprise initiating the rotation. The method may further comprise: withdrawing the downhole tool from the obstruction prior to initiating rotation of the milling portion of the downhole tool; and advancing the rotating milling portion into contact with the obstruction to mill into the obstruction. Continuing operation of the downhole tool until the valve expands and establishes the flowpath may comprise continuing milling until the valve expands and breaks through the obstruction. The method may further comprise, after breaking through the obstruction, adjusting the pumping pressure or flow rate to a circulation pressure or flow rate to circulate the fluid into the wellbore.

Compression of the valve may impart relative motion to first and second components of the downhole tool in a first direction, and expansion of the valve may impart relative motion to the first and second components in a second direction that is substantially opposite the first direction.

Corresponding radial apertures of the first and second components may be substantially aligned within the flowpath when the valve is expanded but not when the valve is compressed.

Conveying the downhole tool may be via tubing extending from the wellsite surface. The tubing may comprise coiled tubing.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same aspects introduced herein. A person having ordinary skill in the art should also realize that such equivalent constructions do not depart from the spirit and scope of the present disclosure, and that they may make various changes, substitutions, and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A method, comprising:

conveying a downhole tool within a wellbore extending from a wellsite surface via tubing until the tool encounters an obstruction in the wellbore, wherein the obstruction imparts an axial force on the tool to shift the tool from an expanded position to an operating position;

holding the downhole tool in the operating position by applying a resistive axial force thereto;

adjusting operation of the downhole tool by adjusting a pumping pressure or flow rate at which fluid is pumped along a flowpath of the tubing to the downhole tool from the wellsite surface;

continuing operation of the downhole tool until the obstruction is cleared;

adjusting operation of the downhole tool by adjusting the pumping pressure or flow rate comprises initiating rotation of a milling portion of the downhole tool, and wherein the method further comprises:

withdrawing the downhole tool from the obstruction while the downhole tool is held in the operating position prior to initiating rotation of the milling portion of the downhole tool; and advancing the rotating milling portion into contact with the obstruction to mill into the obstruction.

2. The method of claim 1 wherein continuing operation of the downhole tool until the obstruction is cleared comprises continuing milling until the milling portion of the downhole tool breaks through the obstruction, and wherein the method further comprises, after breaking through the obstruction, adjusting the pumping pressure or flow rate to a circulation pressure or flow rate to shift the downhole tool to the expanded position to circulate the fluid into the wellbore.

3. The method of claim 2 wherein the circulation pressure or flow rate overcomes the resistive axial force holding the downhole tool in the operating position to enable the downhole tool to be moved to the expanded position.

4. The method of claim 1 wherein the axial force imparted on the downhole tool imparts relative motion to first and second components of the downhole tool in a first direction, and wherein the circulation pressure or flow rate imparts relative motion to the first and second components in a second direction that is substantially opposite the first direction.

5. The method of claim 4 wherein corresponding radial apertures of the first and second components are substantially aligned within the flowpath when the downhole tool is shifted to the expanded position but not when the downhole tool is shifted to the operating position.

6. The method of claim 1 wherein conveying a downhole tool comprises conveying the downhole tool having a valve disposed in the flowpath in fluid communication, the valve comprising an orifice upon which the fluid acts.

7. The method of claim 6 wherein the downhole tool further comprises the orifice operable to react against a pumping pressure of the pumped fluid and thereby urge the valve from the operating position towards the expanded position.

8. The method of claim 1 wherein holding the downhole tool in the operating position comprises engaging a collet with a surface in the downhole tool to impart the resistive axial force to resist shifting the downhole tool from the operating position to the expanded position.

9. A method for performing a milling operation in a wellbore, comprising:

providing a milling tool attached to a tubing, the milling tool comprising a hydraulic milling tool driven by fluid pumped to the hydraulic tool via the tubing; and a valve in fluid communication between the tubing and the hydraulic milling tool, wherein the valve is configurable in the wellbore between:

an expanded position establishing a hydraulic milling tool bypass diverting at least a portion of the pumped fluid away from the hydraulic milling tool; and a compressed position closing the hydraulic milling tool bypass;

conveying the milling tool via the tubing, in the expanded position, within a wellbore extending from a wellsite surface;

pumping a fluid through the tubing at a circulation pressure or flow rate while conveying;

engaging an obstruction in the wellbore, wherein the obstruction imparts an axial force on the milling tool to shift the milling tool to the compressed position;

holding the milling tool in the compressed position;

commencing operation of the milling tool while the tool is held in the compressed position;

adjusting operation of the downhole tool by adjusting the pumping pressure or flow rate through the tubing to a pumping pressure less than the circulation pressure or flow rate;

engaging the milling tool with the obstruction.

10. The method of claim 9 further comprising continuing operation of the milling tool until the obstruction is cleared.

11. The method of claim 9 further comprising, after engaging the obstruction, pumping a fluid through the tubing at the circulation pressure or flow rate and shifting the milling tool from the compressed position to the expanded position.

12. The method of claim 11 further comprising cleaning fill from the wellbore by diverting the pumped fluid from the tool into the wellbore such that the at least a portion of the pumped fluid diverted by the hydraulic tool bypass does not flow through the hydraulic tool.

13. The method of claim 12 further comprising, after cleaning fill from the wellbore, shifting to tool to the compressed position by engaging with the obstruction in the wellbore and resuming the milling operation.

14. The method of claim 9 wherein the downhole tool further comprises an orifice operable to react against a pumping pressure of the pumped fluid and thereby urge the tool from the compressed position towards the expanded position.

15. The method of claim 9 wherein holding the milling tool in the compressed position comprises engaging a collet in the downhole tool to releasably hold the tool in the compressed position.

16. The method of claim 9 further comprising a biasing member urging the tool towards the compressed or expanded position.

* * * * *